US009452873B2

(12) United States Patent
Eberlein et al.

(10) Patent No.: US 9,452,873 B2
(45) Date of Patent: Sep. 27, 2016

(54) JAR AND ROTATABLE LID ASSEMBLY

(71) Applicants: David Jeffrey Eberlein, Los Angeles, CA (US); Timothy Thorpe, Santa Monica, CA (US); Adrian Charles Apodaca, Daly City, CA (US)

(72) Inventors: David Jeffrey Eberlein, Los Angeles, CA (US); Timothy Thorpe, Santa Monica, CA (US); Adrian Charles Apodaca, Daly City, CA (US)

(73) Assignee: HCT Group Holdings Limited, Hong Kong (HK)

( * ) Notice: Subject to any disclaimer, the term of this patent is extended or adjusted under 35 U.S.C. 154(b) by 0 days.

(21) Appl. No.: 14/701,795

(22) Filed: May 1, 2015

(65) Prior Publication Data

US 2015/0314934 A1 Nov. 5, 2015

Related U.S. Application Data

(60) Provisional application No. 61/987,811, filed on May 2, 2014.

(51) Int. Cl.
*B65D 55/16* (2006.01)
*B65D 1/10* (2006.01)
(Continued)

(52) U.S. Cl.
CPC ..... *B65D 55/16* (2013.01); *A45D 33/006* (2013.01); *B65D 1/10* (2013.01); *A45D 2040/227* (2013.01); *A45D 2200/051* (2013.01)

(58) Field of Classification Search
CPC ..... A45D 33/003; A45D 33/006; A45D 33/008; A45D 33/02; A45D 33/025; A45D 33/16; A45D 33/24; A45D 40/0068; A45D 40/22; A45D 40/221–40/222; A45D 2040/227; Y10S 206/823; Y10S 220/26; B65D 1/10; B65D 50/061; B65D 55/16; B65D 2543/00435
USPC ..... 206/581, 823; 132/286, 293–295, 300, 132/304–305, 307, 315; 220/4.22, 291, 220/304, 375, 784, 811, 831, 833, 849, 220/DIG. 26
See application file for complete search history.

(56) References Cited

U.S. PATENT DOCUMENTS 5,896,866 A * 4/1999 Quennessen ..... A45C 13/008 132/293
5,908,037 A * 6/1999 Pierson ..... A45D 33/006 132/293

(Continued)

FOREIGN PATENT DOCUMENTS

WO 2008010628 A1 1/2008

OTHER PUBLICATIONS

PCT Appl. No. US2015/028791, The International Search Report and the Written Opinion of the International Searching Authority mailed Sep. 30, 2015.

*Primary Examiner* — J. Gregory Pickett
*Assistant Examiner* — Brijesh V. Patel
(74) *Attorney, Agent, or Firm* — Seager, Tufte & Wickhem LLP

(57) ABSTRACT

A jar and lid assembly that includes a jar assembly configured to hold a product and a base configured to at least partially house the jar. The jar and lid assembly also includes a rotatable lid assembly pivotably coupled to the jar assembly and includes an outer lid portion and an inner lid portion. The rotatable lid assembly further includes a lid ring having: (i) a hinge portion configured to pivot on an axis of the base such that the rotatable lid assembly is pivotable relative to the jar assembly and (ii) a lid ring protruding portion disposed within the gap and a liner disposed on an underside of the inner lid portion and configured to contact the jar when the rotatable lid assembly is in a rotatably closed position. The outer lid portion and the inner lid portion are configured to be movable relative to the lid ring.

19 Claims, 10 Drawing Sheets

(51) Int. Cl.
*A45D 33/00* (2006.01)
*A45D 40/22* (2006.01)

(56) References Cited

U.S. PATENT DOCUMENTS 6,119,891 A * 9/2000 Favre ..... A45C 13/008 215/223
6,923,335 B2 * 8/2005 Fujita ..... B65D 50/061 132/293
2006/0151355 A1 * 7/2006 Oh ..... A45D 33/008 206/581
2007/0029226 A1 * 2/2007 Yuhara ..... A45D 33/006 206/581
2008/0178903 A1 * 7/2008 Thorpe ..... A45D 33/16 132/307
2009/0188518 A1 * 7/2009 Thorpe ..... A45D 33/003 132/307
2009/0272399 A1 * 11/2009 Kim ..... A45D 33/008 132/293
2011/0240175 A1 * 10/2011 Thorpe ..... A45D 33/003 141/18
2011/0266297 A1 * 11/2011 Thorpe ..... B65D 43/166 220/831
2012/0305442 A1 12/2012 Apodaca
2013/0068801 A1 * 3/2013 Lai ..... A45D 33/16 222/565
2013/0087165 A1 * 4/2013 Lee ..... A45C 13/008 132/286

* cited by examiner

JAR AND ROTATABLE LID ASSEMBLY

CROSS-REFERENCE TO RELATED APPLICATIONS

This application claims priority to U.S. provisional application Ser. No. 61/987,811 filed May 2, 2014, which is incorporated herein by reference in its entirety.

TECHNOLOGY FIELD

The present application relates generally to a jar and lid assembly, and in particular, to a jar and floatable lid assembly.

BACKGROUND

Vessels exist that are portable, convenient to use, and designed to contain volatile and/or aggressive products for use. These types of portable vessels usually consist of a jar and lid assembly, that when assembled together provide an effective barrier for containing the volatile product. The airtight portable vessels may be designed to contain the volatile product with minimal weight loss. Moreover, the airtight portable vessels are designed to contain the volatile product with minimal environmental communication. The jar and/or lid are typically made of a glass, a plastic, a metal, combinations of the foregoing, or the like, that when closed together create an airtight seal. These jar and lid assemblies may be sealed by a thread fastening mechanism, a snap fastening mechanism, or a clamp fastening mechanism, that when fastened together usually compress an O-ring or a gasket interposed by the jar and the lid. Such vessels are used in the cosmetics and personal care industries for containing a product to be applied to a body, where, as described above, the product to be applied to the body may be volatile and/or aggressive. As such, without the vessel's effective barrier the product may degrade and/or expire. Although portable vessels exist, there is a continuing need for more and different vessels and closure mechanisms.

SUMMARY

Embodiments provide a jar and lid assembly that includes a jar assembly and a rotatable lid assembly. The jar assembly includes a jar configured to hold a product and having a circumferential edge disposed at a top of the jar and defining an opening and a base configured to at least partially house the jar. The rotatable lid assembly is pivotably coupled to the jar assembly and includes an outer lid portion having an outer lid side extending substantially perpendicular from an outer lid top of the outer lid portion. The rotatable lid assembly also includes an inner lid portion having an inner lid side extending substantially perpendicular from an inner lid top. The inner lid side is spaced from the outer lid side to provide a gap extending between the outer lid side and the inner lid side. The rotatable lid assembly further includes a lid ring having: (i) a hinge portion configured to pivot on an axis of the base such that the rotatable lid assembly is pivotable relative to the jar assembly. The rotatable lid assembly further includes (ii) a lid ring protruding portion disposed within the gap and a liner disposed on an underside of the inner lid and configured to contact the circumferential edge of the jar when the rotatable lid assembly is in a rotatably closed position. The outer lid portion and the inner lid portion are configured to be movable relative to the lid ring.

According to an embodiment, the lid ring includes a lid ring side facing the outer lid portion and the outer lid portion and inner lid portion are further configured to be movable relative to the lid ring along a length of the lid ring side.

According to another embodiment, the outer lid portion has a lower protrusion and an upper protrusion spaced from the lower protrusion and the lower protrusion moves along the length of the lid ring side.

In one embodiment, the inner lid portion further comprises inner lid threads and the jar further comprises jar threads. When the rotatable lid assembly is pivoted toward the jar assembly, contact between the inner lid threads and the jar threads are configured to prevent movement of the outer lid portion and the inner lid portion relative to the lid ring in a direction toward the hinge portion.

In another embodiment, the outer lid portion and the inner lid portion are configured to be moved relative to the lid ring in a direction away from the hinge portion such that the liner is substantially parallel to the circumferential edge of the jar when the rotatable lid assembly is in a pivotably closed position.

According to one embodiment, the outer lid portion and the inner lid portion are configured to be moved relative to the lid ring in the direction away from the hinge portion in response to a force applied by a user.

According to another embodiment, the lid ring further includes one or more biasing elements disposed at a top of the lid ring and configured to apply a force and the outer lid portion and the inner lid portion are configured to be moved relative to the lid ring in the direction away from the hinge portion in response to the force applied by the one or more biasing elements.

In yet another embodiment, the outer lid and the inner lid are configured to rotate such that inner lid threads rotatively engage the jar threads causing the rotatable lid assembly to move toward the jar assembly and causing a portion of the liner to contact the circumferential edge of the jar to provide a substantially air tight seal of the jar.

According to an aspect of an embodiment, the seal is substantially air tight when an amount of a product in the jar is prevented from escaping the jar after a predetermined period of time has expired from the time the liner contacts the circumferential edge of the jar.

According to another aspect of an embodiment, the seal is substantially air tight when a pressure differential between an atmospheric pressure outside of the jar and a pressure inside of the jar exceeds a predetermined pressure differential threshold.

According to yet another aspect of an embodiment, the seal is substantially air tight when a weight loss of the jar is equal to or greater than a predetermined weight loss threshold.

Embodiments provide a jar and lid assembly that includes a jar assembly and a rotatable lid assembly. The jar assembly includes a jar configured to hold a product. The jar has a circumferential edge disposed at a top of the jar defining an opening and one or more jar snaps extending from the jar. The jar assembly also includes a base configured to house a portion of the jar, the base having snap recesses configured to receive the jar snaps and couple the jar to the base. The rotatable lid assembly is configured to pivot relative to the jar assembly and includes an outer lid portion having an outer lid side extending substantially perpendicular from an outer lid top of the outer lid portion and an inner lid portion having an inner lid side extending substantially perpendicular from an inner lid top. The inner lid side is spaced from the outer lid side to provide a gap extending between the outer lid side and the inner lid side. The rotatable lid assembly also includes a lid ring including: (i) a hinge portion configured to pivot on an axis of the base such that the rotatable lid assembly is pivotable relative to the jar assembly; (ii) a protruding portion disposed within the gap; and (iii) one or more biasing elements disposed at a top of the lid ring and configured to apply a force. The rotatable lid assembly also includes a liner disposed on an underside of the inner lid and configured to contact the circumferential edge of the jar when the rotatable lid assembly is in a rotatably closed position. The outer lid portion and the inner lid portion are configured to move relative to the lid ring in a first direction toward the hinge portion. The outer lid portion and the inner lid portion are configured to move in a second direction away from the hinge portion in response to the force applied by the one or more biasing elements.

Embodiments provide a rotatable lid assembly for use with a jar and lid assembly. The rotatable lid assembly includes an outer lid portion having an outer lid side extending substantially perpendicular from an outer lid top of the outer lid portion and an inner lid portion having an inner lid side extending substantially perpendicular from an inner lid top. The inner lid side is spaced from the outer lid side to provide a gap extending between the outer lid side and the inner lid side. The rotatable lid assembly also includes a lid ring that includes: (i) a hinge portion configured to pivot the rotatable lid assembly relative to a jar assembly having a jar and a base portion; and (ii) a lid ring protruding portion disposed within the gap. The rotatable lid assembly further includes a liner disposed on an underside of the inner lid and configured to contact a circumferential edge of the jar of the jar assembly when the rotatable lid assembly is in a rotatably closed position relative to the jar. The outer lid portion and the inner lid portion are configured to be movable relative to lid ring.

According to an embodiment, the lid ring includes a lid ring side facing the outer lid portion and the outer lid portion and inner lid portion are further configured to be movable relative to the lid ring along a length of the lid ring side.

According to another embodiment, the outer lid portion includes a lower protrusion and an upper protrusion spaced from the lower protrusion and the lower protrusion moves along the length of the lid ring side.

In one embodiment, the inner lid portion further includes inner lid threads configured to contact jar threads of the jar assembly to prevent movement of the outer lid portion and the inner lid portion relative to the lid ring in a direction toward the hinge portion In another embodiment, the outer lid portion and the inner lid portion are configured to be moved relative to the lid ring in a direction away from the hinge portion such that the liner is substantially parallel to the circumferential edge of the jar when the rotatable lid assembly is in a pivotably closed position.

According to one embodiment, the outer lid portion and the inner lid portion are configured to be moved relative to the lid ring in the direction away from the hinge portion in response to a force applied by a user.

According to another embodiment, the lid ring further includes one or more biasing elements disposed at a top of the lid ring and configured to apply a force and the outer lid portion and the inner lid portion are configured to be moved relative to the lid ring in the direction away from the hinge portion in response to the force applied by one or more biasing elements.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF EXEMPLARY EMBODIMENTS

Figure 1:
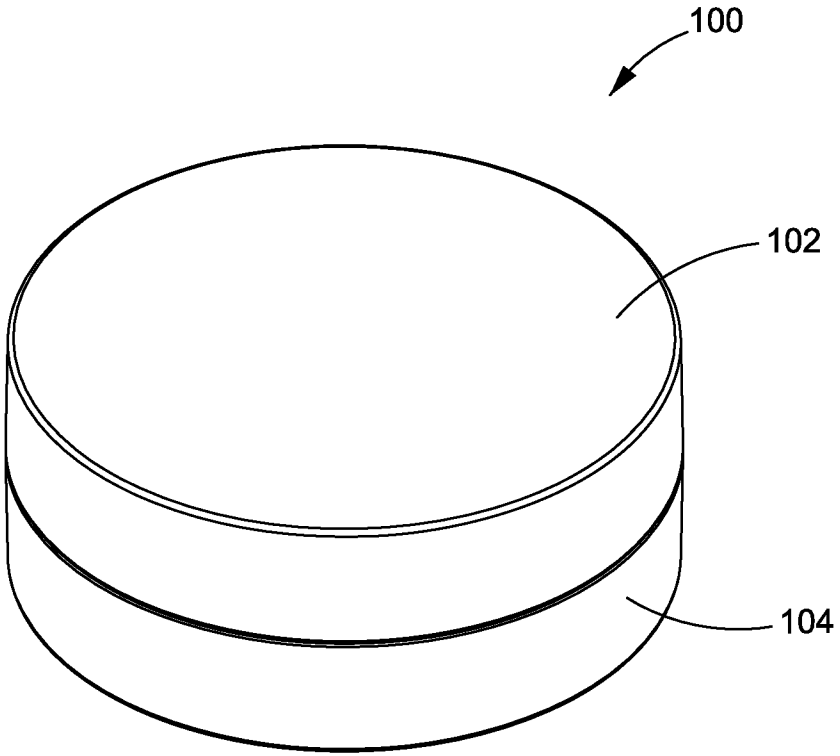
FIG. 1 is a perspective view of a jar and lid assembly according to embodiments disclosed herein.

FIG. 1 is a perspective view of a jar and lid assembly 100 according to embodiments disclosed herein. As shown at FIG. 1, assembly 100 may include lid assembly 102 and a jar assembly 104. Jar and lid assembly 100 in FIG. 1 is shown in a closed position with lid assembly 102 covering jar assembly 104.

Figure 2:
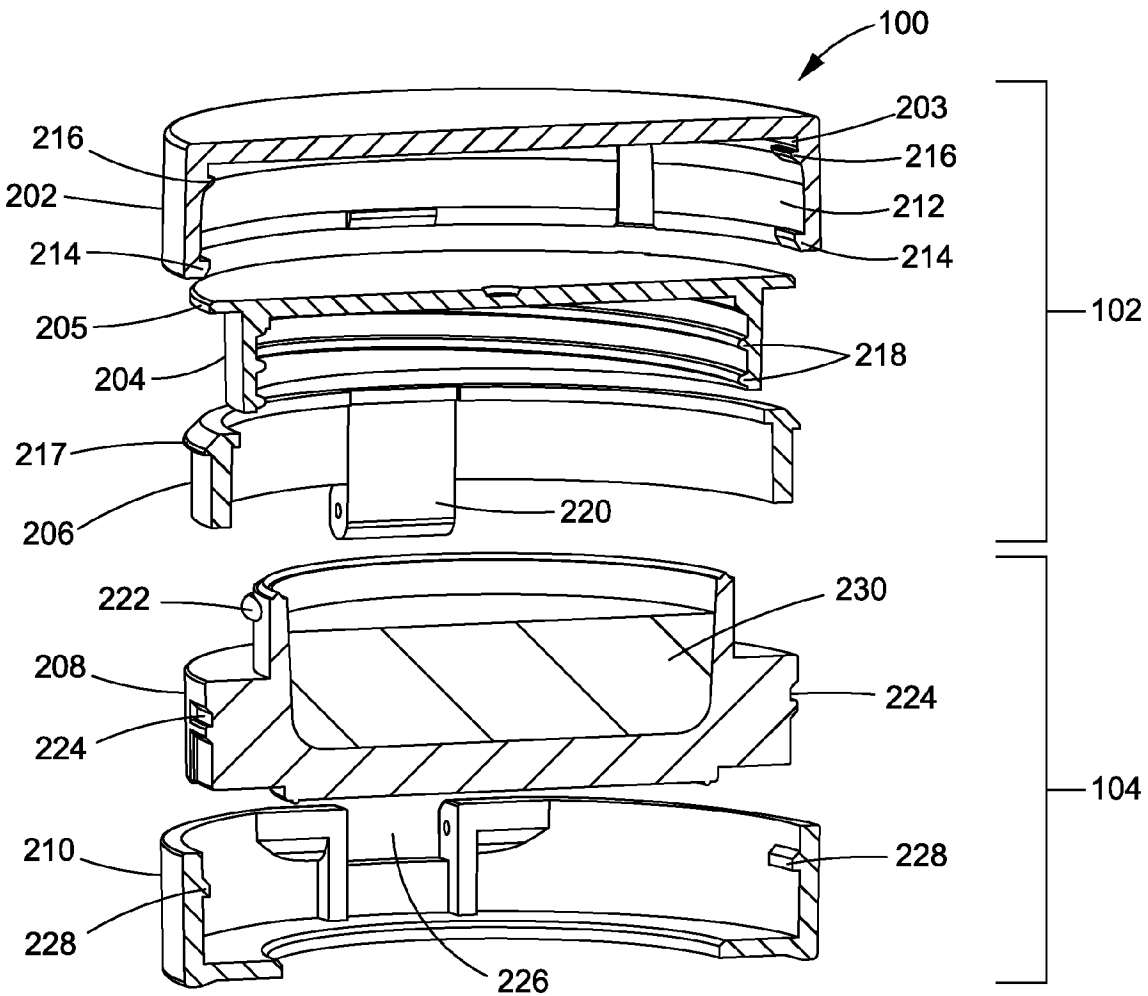
FIG. 2 is an exploded view of the jar and lid assembly according to embodiments disclosed herein.

FIG. 2 is an exploded view of a jar and lid assembly 100 shown in FIG. 1 according to embodiments disclosed herein. As shown in FIG. 2, lid assembly 102 may include an outer lid portion 202, an inner lid portion 204, and lid ring 206. Outer lid portion 202 may include lower protrusion 214 and upper protrusion 216. Inner lid portion 204 includes inner lid threads 218 and lid ring 206 includes a hinge portion 220 (hereinafter hinge) and a lid ring protrusion 217.

Jar assembly 104 may include jar 208 configured to hold a product 230 and base 210 configured to be coupled to the jar and provides support for the rotating and/or pivoting the lid assembly relative to the jar assembly 104. Base 210 may be configured to house the jar 208. For example, in the embodiments shown at FIG. 3 through FIG. 4E, portions of the base 210 may enclose the bottom of the jar 208 and circumferential side of the jar 208. The term "house" used herein may, however, refer to any portion of base 210 being adjacent to, coupled to, enclosing or covering any portion of jar 208. For example, in other embodiments, the base may be ring shaped and may house the jar 208 by enclose a portion of the circumferential side of the jar 208 without enclosing the bottom of the jar 208.

Exemplary jar and lid assemblies may be used to hold any type of product 230, but may be particularly well suited for cosmetics that may include, but are not limited to loose powders (e.g., for eye, cheek, face, and the like), creams (e.g., skincare, eye, foundation, and the like), sunscreen, hot pour products (e.g., lipsticks, glosses, and the like), touchup, spot cover, baked powders, moisturizers, hair creams, gels, serums, and the like.

Jar 208 includes jar threads 222 and jar recesses 224. Base 210 may include a base recess 226 configured to receive hinge 220 of lid ring 206. Base 210 may also include base protrusions 228 configured to engage jar recesses 224 to couple base 210 to jar 208. The size, shape, locations, and number of base protrusions 228 shown in FIG. 2 are merely exemplary. In some embodiments, base protrusions 228 may be formed continuously around base 210 and jar recesses 224 may be formed continuously around jar 208. Embodiments may also include other elements and methods of coupling bases and jars, such as ultrasonic welds, glue, friction fit, and the like.

Outer lid portion 202 and inner lid portion 204 are rotatably movable relative to the lid ring 206. Further, lid assembly 102 is pivotably movable with respect to jar assembly 104 via hinge 220.

In the embodiment shown in FIG. 2, the jar 208 is made from a rigid material (e.g., glass, metal, alloy, wood, and the like). Other embodiments may, however, include jars made from a flexible or semi-rigid material, such as plastic. The jar and lid assembly 100 shown in FIG. 5 includes a jar 208 made from a flexible material, as described in more detail below with reference to FIG. 5.

Figure 3:
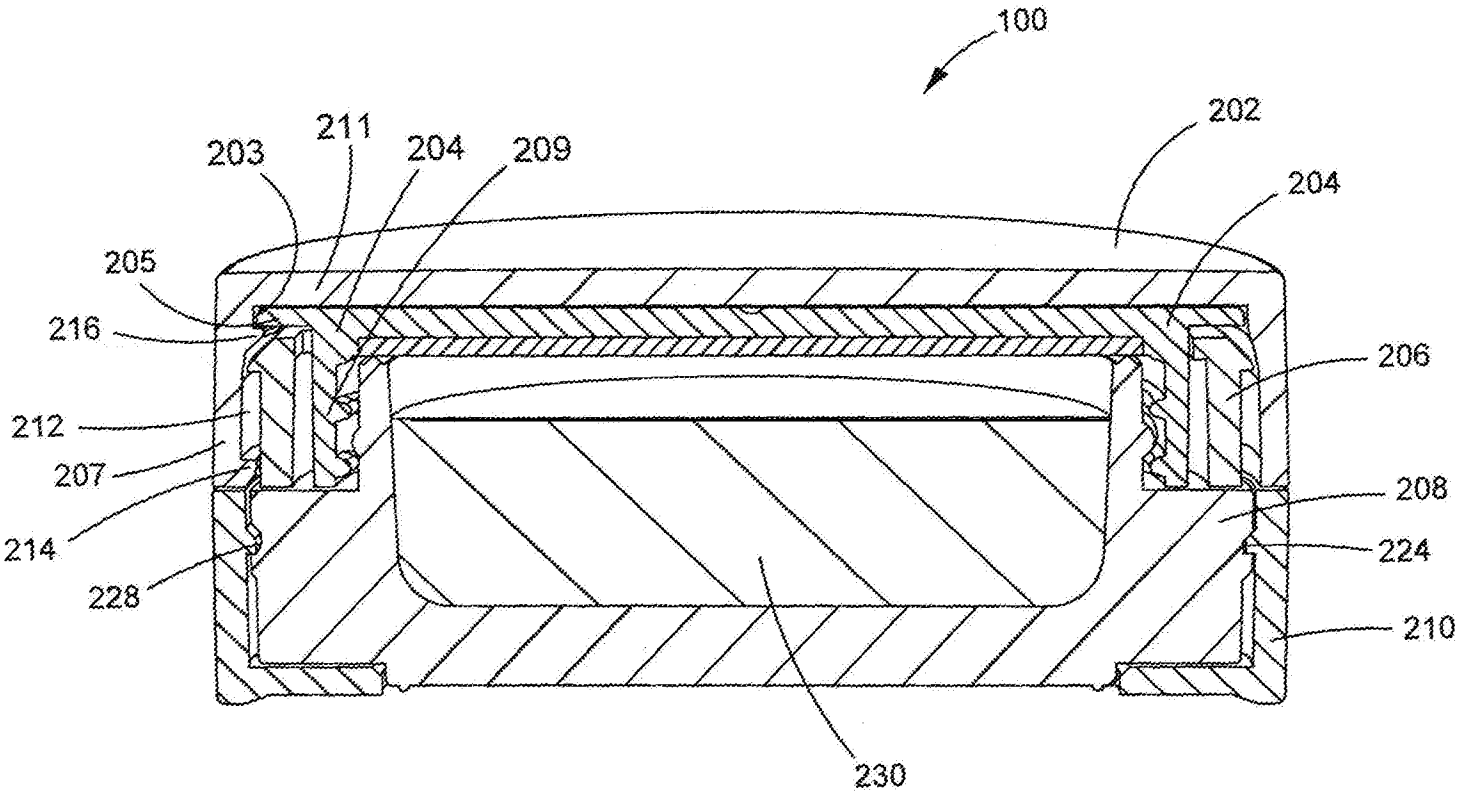
FIG. 3 is a cross sectional view of the jar and lid assembly shown in FIG. 2 according to embodiments disclosed herein.

FIG. 3 is a cross sectional view of the jar and lid assembly 100 shown in FIG. 2 according to embodiments disclosed herein. FIG. 3 illustrates the jar and lid assembly 100 in a closed position. In the embodiment shown at FIG. 3, outer lid portion 202 and inner lid portion 204 are separate elements that are coupled together. As shown, outer lid portion 202 is coupled to an inner lid portion 204 via upper lid recess 203 and the upper protrusion 216. Outer lid portion 202 includes an outer lid side 207 extending substantially perpendicular from an outer lid top 211 of the outer lid portion 202. Inner lid portion 204 includes an inner lid side 209 extending substantially perpendicular from an inner lid top 205. The outer lid side 207 is spaced from the inner lid side 209, thereby providing a gap 212 between the outer lid side 207 and the inner lid side 209. The gap extends widthwise between the outer lid side 207 of the outer lid portion 202 and the inner lid side 209 of the inner lid portion 204 and extends lengthwise between the lower protrusion 214 and the upper protrusion 216 of outer lid portion 202. Embodiments may also include outer lid portions and inner lid portions coupled together using other coupling techniques, including fasteners, snaps, adhesives, ultrasonic welding, and the like. In some embodiments, outer lid portion 202 and inner lid portion 204 may be a single unitary element. In the embodiment shown at FIG. 3, jar 208 and base 210 are coupled together. As shown, jar 208 is coupled to base 210 via base protrusions 228 engaging jar recesses 224. Embodiments may also include jars and bases coupled together using other coupling techniques, including fasteners, snaps, adhesives, and the like. In some embodiments, jar 208 and base 210 may be a single unitary element.

Figure 4A:
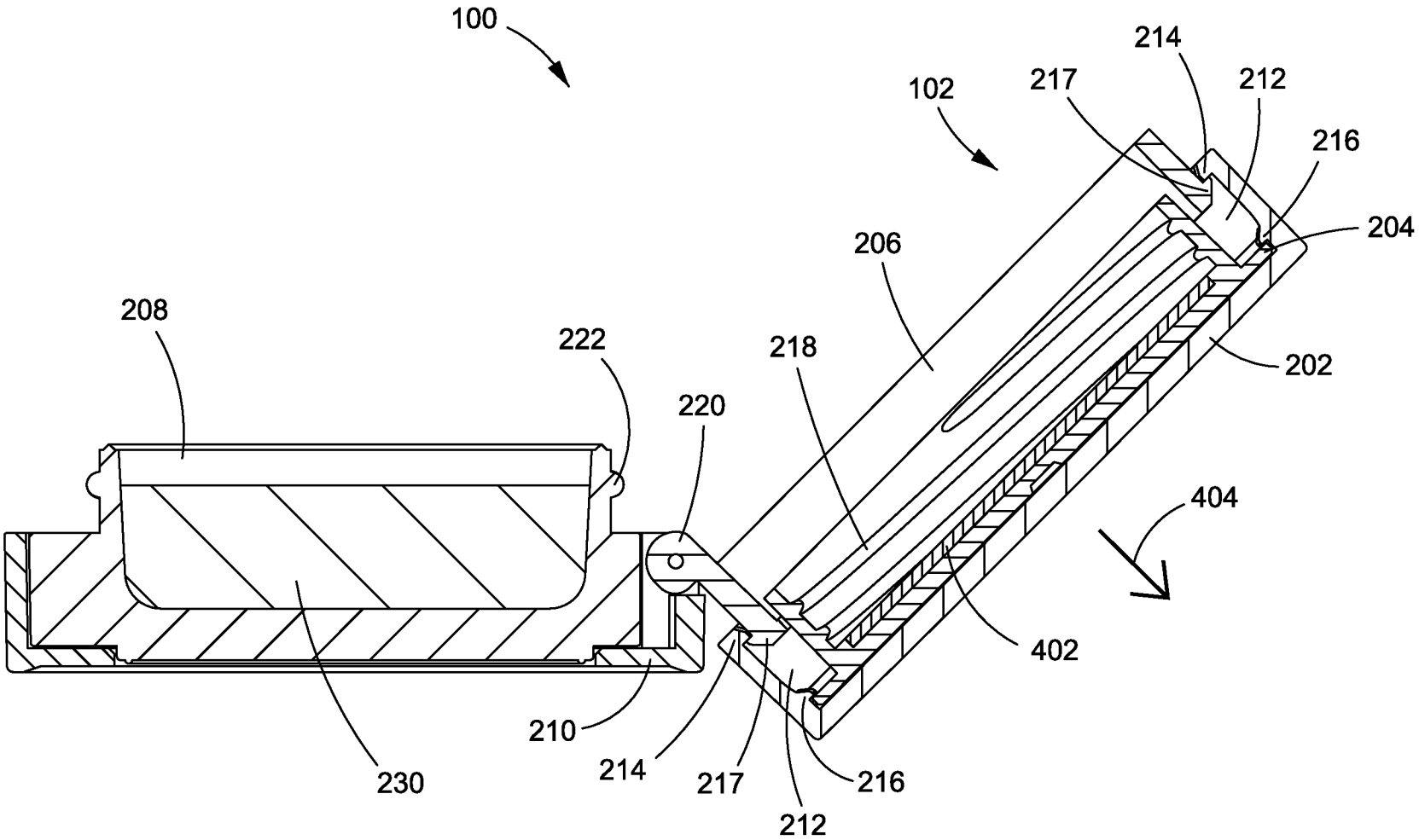
FIG. 4A through FIG. 4E are cross sectional views of the jar and lid assembly illustrating the assembly at different states according to embodiments disclosed herein.

FIG. 4A through FIG. 4E are cross sectional views of jar and lid assembly 100 illustrating the assembly at different states according to embodiments disclosed herein. FIG. 4A is a cross sectional view of jar and lid assembly 100 in a fully open position. As shown in FIG. 4A, the lid assembly 102 of jar and lid assembly 100 also includes a liner 402 disposed to an underside of the inner lid 204. Exemplary liners may include, but are not limited to, materials such as polyethylene (low-density polyethylene, medium-density polyethylene, high-density polyethylene), expanded polyethylene, polyethylene terephthalate, silicone, rubber, polypropylene, polyoxymethylene, and acrylonitrile butadiene styrene. In other embodiments, liners may be integrated via manufacturing techniques such as overmolding, or may alternatively be integrated via features in the inner lid (such as sealing ribs).

As will now be described further with reference to FIGS. 4A to 4E, outer lid 202 and inner lid 204 are moveable relative to the lid ring 206. When the lid assembly 102 is pivoted via hinge 220 to the fully open position shown in FIG. 4A, outer lid 202 and inner lid 204 move in the direction of arrow 404 relative to lid ring 206 such that lid ring protrusion 217 of lid ring 206 is engaged with lower protrusion 214 of outer lid 202. Further, when lid ring protrusion 207 engages lower protrusion 214, further movement of outer lid 202 and inner lid 204 is prevented or limited in the direction of arrow 404.

Figure 4B:
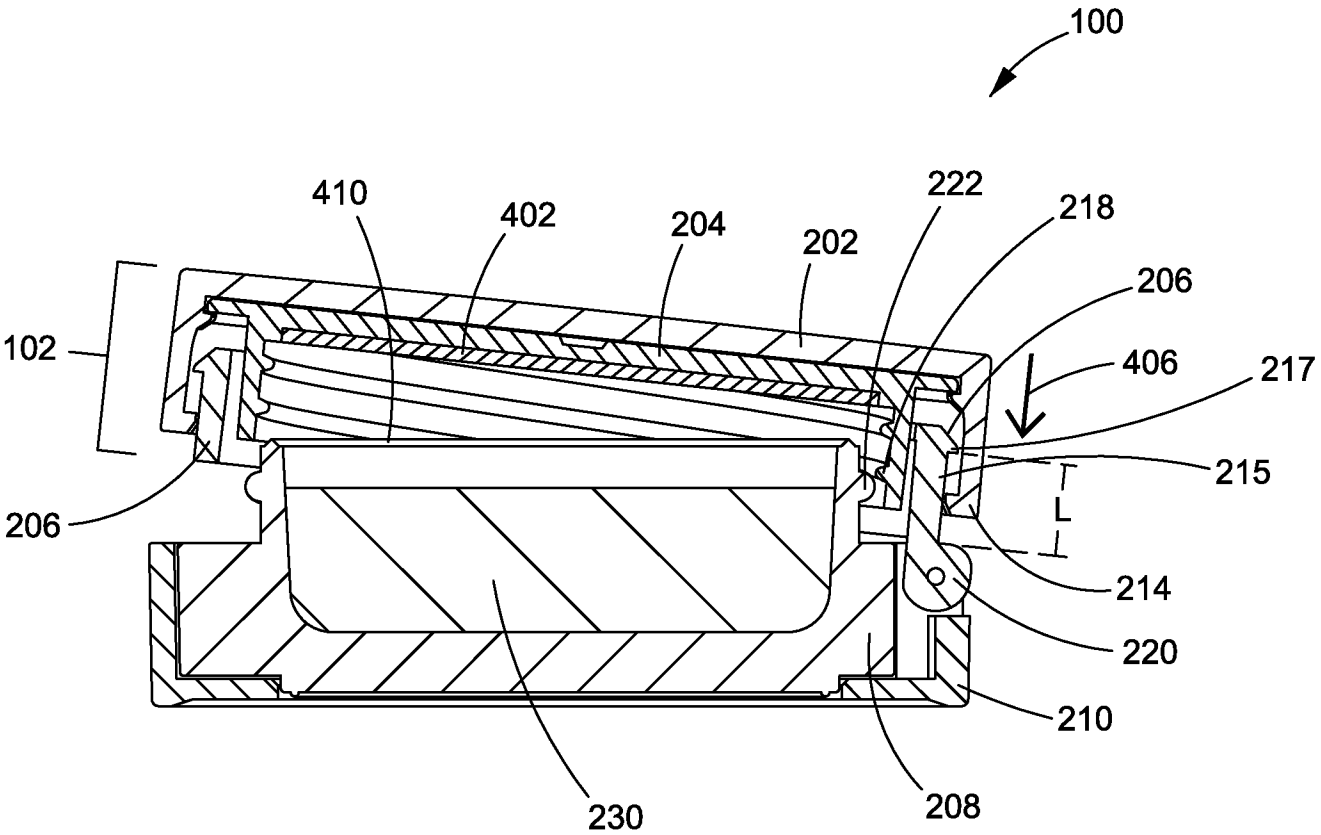

FIG. 4B is a cross sectional view of jar and lid assembly 100 in a partially open position. As shown in FIG. 4B, the lid ring includes a lid ring side 215 facing the outer lid portion 202 and extending a length L of lid ring side 215 and the hinge portion 220. As the lid assembly 102 is pivoted via hinge 220 from the fully open position shown in FIG. 4A, outer lid 202 and inner lid 204 begin to move relative to lid ring 206 in the direction of arrow 406 toward hinge portion 220 such that lower protrusion 214 moves along length L of lid ring 206.

As shown in FIG. 4B, however, when the lid assembly 102 is pivoted via hinge 220 to the partially open position shown in FIG. 4B, inner lid threads 218 of inner lid 204 begin to contact jar threads 222 of jar 208 and prevent further movement of outer lid 202 and inner lid 204 relative to lid ring 206 in the direction of arrow 406 toward hinge portion 220 and therefore prevent further movement of liner 402 toward jar 208. That is, contact between inner lid threads 218 and jar threads 222 may provide a resistive force preventing further movement of outer lid 202 and inner lid 204 relative to lid ring 206 in the direction of arrow 406 toward hinge portion 220 and therefore prevent further movement of liner 402 toward jar 208. Preventing further movement of liner 402 toward jar 208 may prevent a portion of liner 402 (e.g., the right side of liner 402 shown in FIG. 4B) from contacting a portion of jar 208 (e.g., the right side of jar 208 shown in FIG. 4B) and prevent liner 402 from contacting the circumferential edge 410 of jar 208 thereby preventing a good seal within the jar 208, as described in more detail below.

The position of jar and lid assembly 100 shown in FIG. 4B is merely exemplary. Initial contact between the inner lid threads 218 and jar threads 222 may occur at positions other than the position of jar and lid assembly 100 shown at FIG. 4B due to the jar and lid assembly 100 having three degrees of freedom.

Figure 4C:
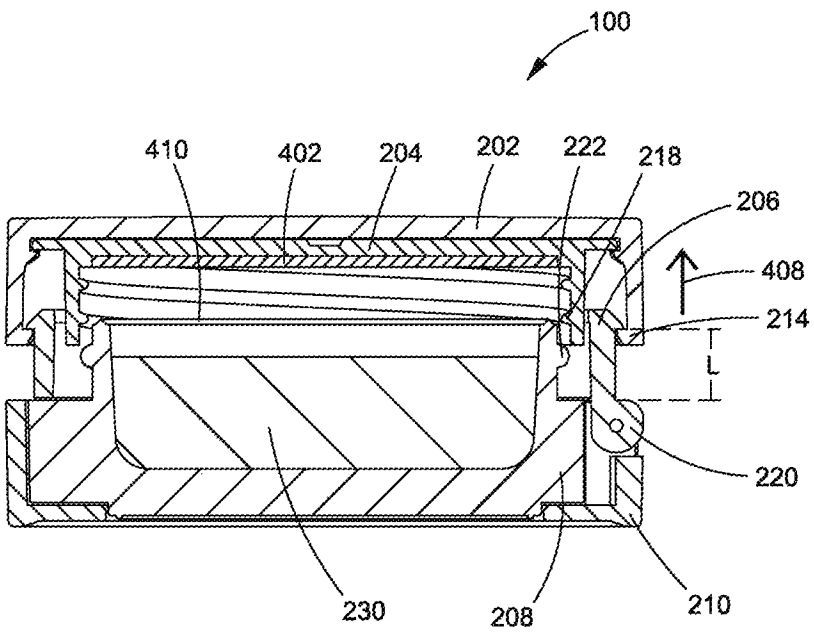

FIG. 4C is a cross sectional view of jar and lid assembly 100 in a pivotably closed position. In the pivotably closed position, the lid assembly 102 is pivoted, via hinge 220 such that inner lid threads 218 of inner lid 204 are configured to be engaged with jar threads 222 of jar 208, while the inner lid threads 218 of inner lid 204 remain free of contact with the jar threads 222 of jar 208. As the lid assembly 102 is pivoted from the partially open position shown in FIG. 4B to the pivotably closed position shown in FIG. 4C, outer lid 202 and inner lid 204 are moved relative to lid ring 206 in the direction of arrow 408 toward hinge portion 220 relative to lid ring 206 away from hinge portion 220 such that lower protrusion 214 moves along length L of lid ring 206 until lid ring 206 engages lower protrusion 214. That is, the outer lid 202 and the inner lid 204 are moved relative to the lid ring 206 in the direction away from the hinge portion 220 such that the liner 402 is substantially parallel to the circumferential edge 410 disposed at a top of the jar 208 when the rotatable lid assembly 102 has pivoted to the pivotably closed position.

In one embodiment, the outer lid 202 and inner lid 204 are moved relative to lid ring 206 in the direction of arrow 408 in response to a force (e.g., lifting force) by a user (not shown). In another embodiment, the outer lid 202 and inner lid 204 are moved relative to lid ring 206 in the direction of arrow 408 from a biasing force (e.g., spring force), as further described below with regard to FIG. 5.

Figure 4D:
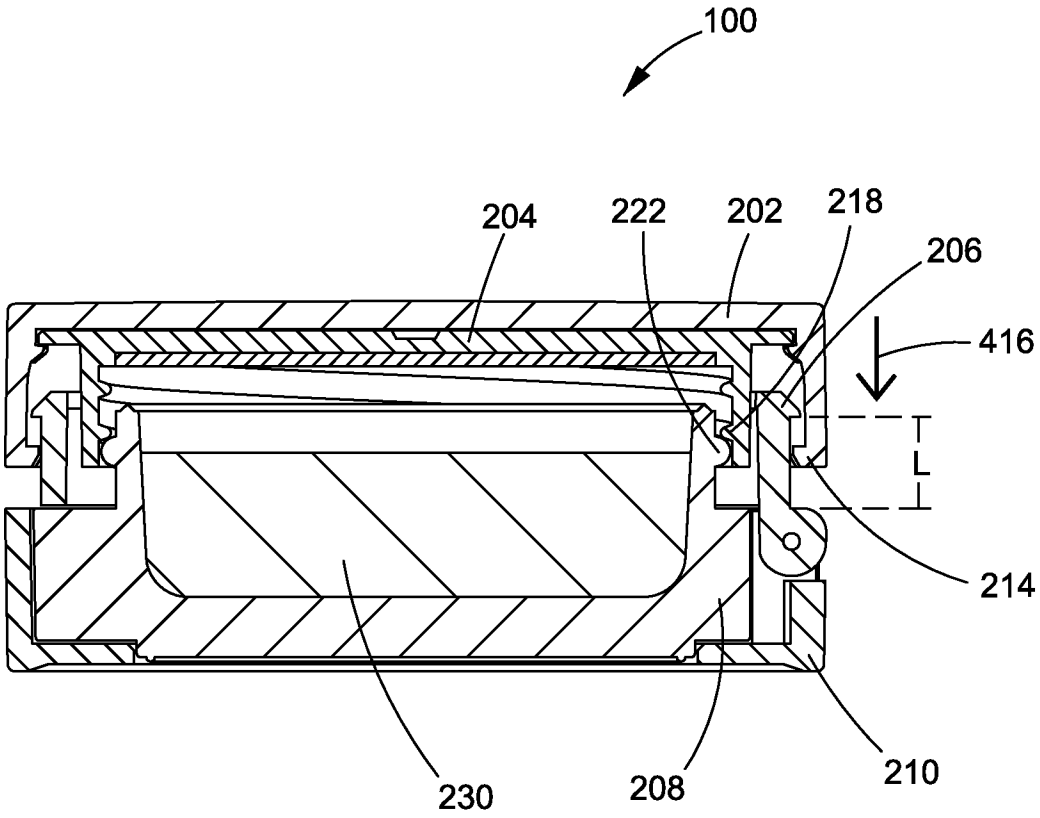

FIG. 4D is also a cross sectional view of jar and lid assembly 100 in a pivotably closed position. As shown in FIG. 4D, however, outer lid 202 and inner lid 204 may then move from their positions shown in 4C to their positions shown in FIG. 4D. For example, the positions of outer lid 202 and inner lid 204 may move relative to lid ring 206 in the direction of arrow 416 (direction relative to lid ring 206) such that lower protrusion 214 moves along length L of lid ring 206 and inner lid threads 218 of inner lid 204 begin to contact jar threads 222 of jar 208. In one embodiment, the outer lid 202 and inner lid 204 are moved relative to lid ring 206 in the direction of arrow 416 due to a gravitational force. In another embodiment, the outer lid 202 and inner lid 204 are moved relative to lid ring 206 in the direction of arrow 416 in response to a force (e.g., downward force or compressive force applied to the lid and base assembly 100) by a user (not shown), as further described below with regard to FIG. 5.

Figure 4E:
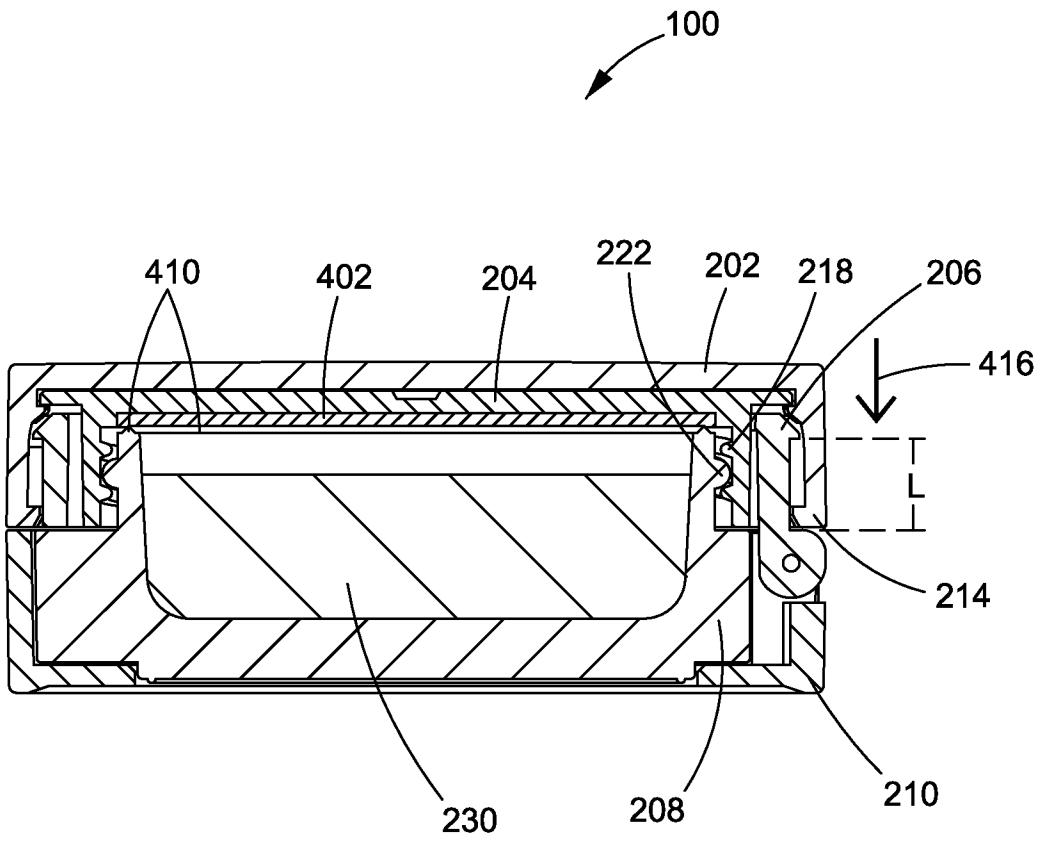

FIG. 4E is a cross sectional view of jar and lid assembly 100 in a rotatably closed position. The outer lid 202 and inner lid 204 may be rotated (e.g., by a user not shown) such that inner lid threads 218 rotatively engage jar threads 222 causing outer lid 202 and inner lid 204 to move in the direction of the arrow 416 shown in FIG. 4D and FIG. 4E until liner 402 contacts the circumferential edge 410 of jar 208, thereby providing a good seal, in some embodiments a substantially air tight seal, with the jar 208. As described above with reference to FIG. 4B, preventing further movement of liner 402 toward jar 208 may prevent a portion of liner 402 (e.g., the hinge side) of liner 402 shown in FIG. 4B) from contacting a portion of jar 208 (e.g., the right side of jar 208 shown in FIG. 4B) and prevent liner 402 from contacting the circumferential edge 410 of jar 208 to provide a good seal, possibly making a substantially air tight seal with the jar 208 difficult to attain.

Embodiments may include any number of thread arrangements (e.g., single threading, double threading, triple threading, etc.) Embodiments may, however, be well suited for multiple numbers of thread arrangements (more than single threading) to facilitate providing a substantially air tight seal. For example, double threading may provide multiple starting points when inner lid threads start to rotatively engaging jar threads, which may provide a more even start of thread engagement between the lid and jar, provide less wobble and help to facilitate a substantially air tight seal.

Embodiments may also include restraints configured to stop rotation of the lid after rotating a predetermined number of degrees (e.g., 180 degrees) which may decrease the possibility of cross threading. Constraints may be located on jars or lids such that information (e.g., word, pictures, logos and the like) may be in a predetermined orientation (right side up) with respect to hinges or another elements of jar and lid assemblies.

Whether the seal is substantially air tight may be determined by whether any amount of material (e.g., fluid) in the orifice 209 of the jar 208 is able to escape from a containment zone (e.g., orifice 209) of a container (e.g., jar 208) after a predetermined period of time (e.g., 10 min) has expired from the time the liner 402 contacts the circumferential edge 410 of jar 208. Whether the seal is substantially air tight may be determined by a vacuum test. For example, after the predetermined period of time (e.g., 10 min) has expired, the jar and lid assembly 100 itself or product 230 configured to indicate the presence of leaking material (e.g., paper towel) that is placed on or adjacent to the jar and lid assembly 100 may be checked to identify any amount of leaked material. If any material is identified, then the seal may be determined to not be substantially air tight.

Whether the seal is substantially air tight may also be determined by whether a pressure differential between the atmospheric pressure (pressure outside of the vacuum) and the pressure inside of the vacuum (e.g., pressure within the sealed orifice 209) exceeds a predetermined differential threshold. For example, after expiration of the predetermined period of time (e.g., 10 min), the seal may be determined to be substantially air tight if the pressure differential is equal to or greater than about 25 inHg (which translates to a gauge pressure of −25 inHg, aka 25 inHg vacuum, or an absolute pressure of 4.9 inHg).

Whether the seal is substantially air tight may also be determined by whether the weight loss of the jar 208 or the weight loss of the jar and lid assembly 100 is equal to or greater than a predetermined weight loss threshold (e.g., a percentage (e.g., 2%) of the weight) after a predetermined amount of time has expired from the time the jar and lid assembly 100 is sealed. The predetermined amount of time may be any amount of time (minutes, hours, weeks or months). The weight loss test is not dispositive on the effectiveness of the seal for some products, because some products may permeate through the various materials used to make the jar, seal, and lid.

In any of the embodiments described above for determining whether the seal is substantially air tight, the jar 208 may be placed under one or more environmental conditions (e.g., ambient temperature, elevated temperature, lowered temperature, humidity, and the like) during the predetermined amount of time. In some embodiments, the seal need not be substantially airtight, but merely form a good seal so as to minimize product loss during shifting of the jar and lid assembly and to minimize air exposure compared to containers without any seal.

Figure 5:
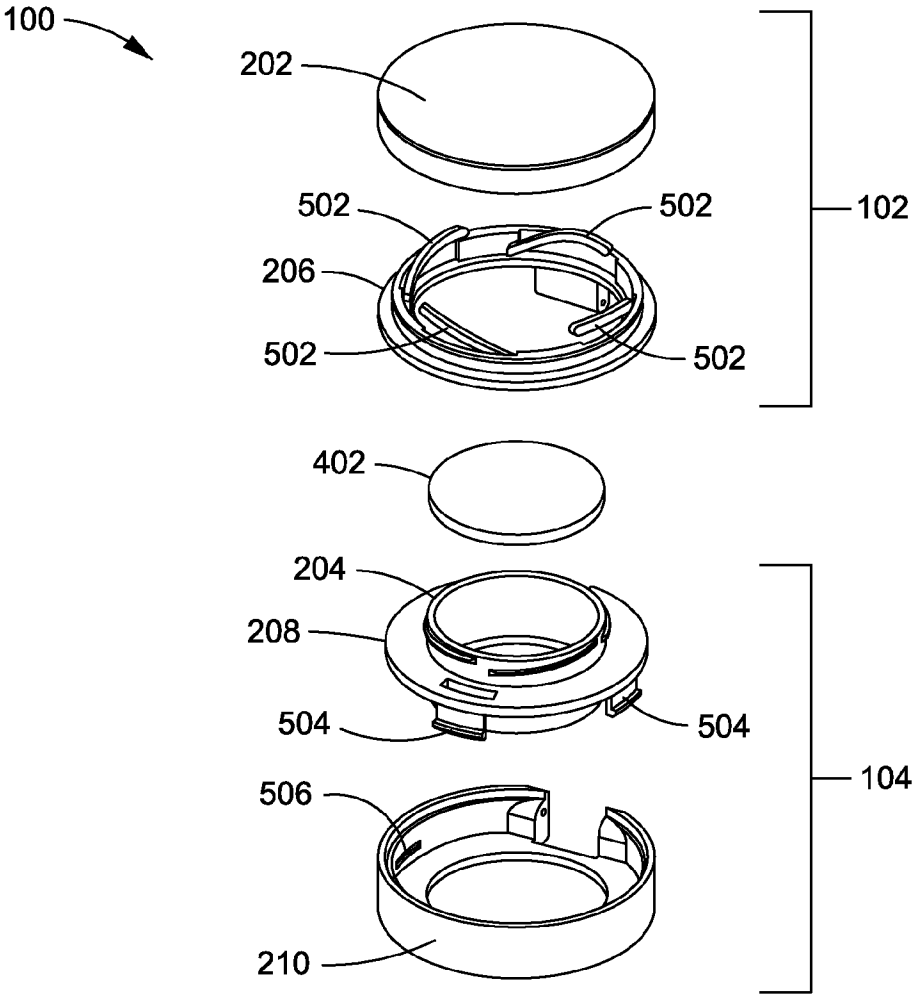
FIG. 5 is an exploded view of a jar and lid assembly having lid rim biasing elements and jar snaps according to embodiments disclosed herein.

FIG. 5 is an exploded view of a jar and lid assembly 100 that includes a lid ring 206 having integral springs 502. As described above, when the lid assembly 102 is pivoted to the pivotably closed position shown in FIG. 4C, outer lid 202 and inner lid 204 may be moved relative to lid ring 206 in the direction of arrow 408 (direction relative to lid ring 206) such that lower protrusion 214 moves along length L of lid ring 206 until lid ring 206 engages lower protrusion 214. This movement in the direction of arrow 408 may be caused by a force applied by springs 502. The location, shape, size, and number of springs 502 shown in FIG. 5 are merely exemplary. Embodiments may include any number of springs having other shapes, sizes, and locations. Embodiments may also include any biasing elements, other than springs, that are configured to apply a force to cause outer lid 202 and inner lid 204 to move relative to lid ring 206 in the direction of arrow 408.

To overcome the biasing force exerted by springs 502, the outer lid 202 and inner lid 204 may then be moved relative to lid ring 206 in the direction of arrow 416 (shown in FIG. 4D) in response to a force (e.g., downward force) by a user (not shown) until the inner lid threads 218 begin to contact jar threads 222, as shown in FIG. 4D. The outer lid 202 and inner lid 204 may then be rotated such that inner lid threads 218 rotatively engage jar threads 222 causing outer lid 202 and inner lid 204 to move in the direction of the arrow 416 shown in FIG. 4D and FIG. 4E until liner 402 contacts the circumferential edge 410 of jar 208.

Jar and lid assembly 100 shown in FIG. 5 also includes a jar 208 having jar snaps 504 and a base 210 having snap recesses 506 configured to receive jar snaps 504 and couple jar 208 to base 210 according to embodiments disclosed herein. This embodiment is well suited to be made from plastics materials such that jar snaps 504 are resilient in nature such that they bend to engage snap recesses 506 to couple the jar 208 and base 210 to one another. In some embodiments, jar 208 may be fixedly coupled to base 210. In other embodiments, jar 208 may be removably coupled to base 210. The size, shape, locations, and number of jar snaps 504 and snap recesses 506 shown in FIG. 5 are merely exemplary. In some embodiments, jar recesses 224 may be formed continuously around base 210 and jar snaps 504 may be formed continuously around jar 208. Embodiments may also include jars and bases coupled together using other coupling techniques, including fasteners, adhesives, friction fit, and the like. In some embodiments, jar 208 and base 210 may be a single unitary element.

Figure 6:
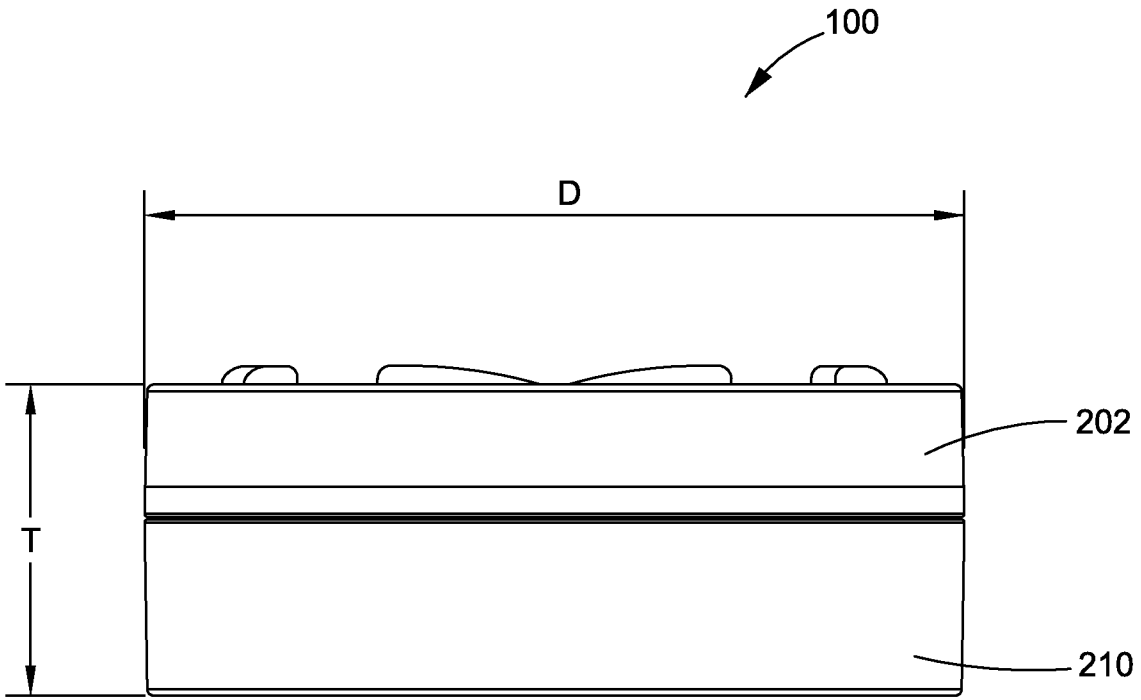
FIG. 6 is a side view of a jar and lid assembly according to embodiments disclosed herein.

FIG. 6 is a side view of a jar and lid assembly 100 illustrating exemplary dimensions according to embodiments disclosed herein. As shown in FIG. 6, jar and lid assembly 100 includes an outer diameter D and a thickness T. The size, shape, and dimensions shown in FIG. 6, however, are merely exemplary. Exemplary jar and lid assemblies may vary in shape, sizes, and dimensions. For example, exemplary jar and lid assemblies may include outer diameters ranging from about 27 mm to about 93 mm. Exemplary jar and lid assemblies may also include jars having opening diameters ranging from about 7 mm to about 73 mm. Exemplary jar and lid assemblies may further include thicknesses ranging from about 0.75 mm to about 10 mm. For example, exemplary jar and lid assemblies may include but are not limited to the following dimensional combinations: (i) an opening diameter of 27 mm and an outer diameter of 47 mm; (ii) an opening diameter of 40 mm and an outer diameter of 60 mm; and (iii) an opening diameter of 53 mm and an outer diameter of 73 mm.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A jar and lid assembly comprising:

a jar assembly comprising:

a jar configured to hold a product and having a circumferential edge disposed at a top of the jar and defining an opening; and a base configured to at least partially house the jar and having a base recess; and a rotatable lid assembly pivotably coupled to the jar assembly, the rotatable lid assembly comprising:

an outer lid portion having an outer lid side extending substantially perpendicular from an outer lid top of the outer lid portion;

an inner lid portion having an inner lid side extending substantially perpendicular from an inner lid top, the inner lid portion coupled to the outer lid portion at a coupling region adjacent the inner lid top and the outer lid top and the inner lid side being spaced from the outer lid side to provide a gap extending between the outer lid side and the inner lid side;

a lid ring having: (i) a hinge portion pivotably coupled to the base recess such that the rotatable lid assembly is pivotable relative to the jar assembly; and (ii) a lid ring protruding portion disposed within the gap extending between the outer lid side and the inner lid side; and a liner disposed on an underside of the inner lid portion and configured to contact the circumferential edge of the jar when the rotatable lid assembly is in a rotatably closed position, wherein the outer lid portion and the inner lid portion are configured to be movable simultaneously relative to the lid ring.

2. The jar and lid assembly according to claim 1, wherein the lid ring has a lid ring side surface extending between the hinge portion and the lid ring protruding portion, the surface facing the outer lid portion, and the outer lid portion and inner lid portion are further configured to be movable along a length of the lid ring outer side surface.

3. The jar and lid assembly according to claim 2, wherein the outer lid portion includes a lower protrusion and an upper protrusion spaced from the lower protrusion, and the lower protrusion moves along the length of the lid ring side.

4. The jar and lid assembly according to claim 1, wherein the inner lid portion further comprises inner lid threads and the jar further comprises jar threads, and when the rotatable lid assembly is pivoted toward the jar assembly, contact between the inner lid threads and the jar threads provides a resistive force configured to prevent movement of the outer lid portion and the inner lid portion relative to the lid ring in a direction toward the hinge portion.

5. The jar and lid assembly according to claim 1, wherein the outer lid portion and the inner lid portion are configured to be moved from a partially open position towards a closed position and in a direction away from the hinge portion such that the liner is substantially parallel to the circumferential edge of the jar when the rotatable lid assembly is in a pivotably closed position.

6. The jar and lid assembly according to claim 5, wherein the outer lid portion and the inner lid portion are configured to be moved relative to the lid ring in the direction away from the hinge portion in response to a force applied by a user.

7. The jar and lid assembly according to claim 5, wherein the lid ring further comprises one or more biasing elements disposed at a top of the lid ring and configured to apply a force, and the outer lid portion and the inner lid portion are configured to be moved relative to the lid ring in the direction away from the hinge portion in response to the force applied by the one or more biasing elements.

8. The jar and lid assembly according to claim 5, wherein the outer lid and the inner lid are configured to rotate such that inner lid threads rotatively engage the jar threads causing the rotatable lid assembly to move toward the jar assembly and causing a portion of the liner to contact the circumferential edge of the jar to provide a substantially air tight seal of the jar.

9. The jar and lid assembly according to claim 8, wherein the seal is substantially air tight when an amount of a product in the jar is prevented from escaping the jar after a predetermined period of time has expired from the time the liner contacts the circumferential edge of the jar.

10. The jar and lid assembly according to claim 8, wherein the seal is substantially air tight when a pressure differential between an atmospheric pressure outside of the jar and a pressure inside of the jar exceeds a predetermined pressure differential threshold.

11. The jar and lid assembly according to claim 8, wherein the seal is substantially air tight when a weight loss of the jar is equal to or greater than a predetermined weight loss threshold.

12. A jar and lid assembly comprising:

a jar assembly comprising:

a jar configured to hold a product, the jar having a circumferential edge disposed at a top of the jar defining an opening and one or more jar snaps extending from the jar; and a base configured to house a portion of the jar, the base having snap recesses configured to receive the jar snaps and couple the jar to the base; and a rotatable lid assembly configured to pivot relative to the jar assembly, the lid assembly comprising:

an outer lid portion having an outer lid side extending substantially perpendicular from an outer lid top of the outer lid portion;

an inner lid portion having an inner lid side extending substantially perpendicular from an inner lid top, the inner lid side being spaced from the outer lid side to provide a gap extending between the outer lid side and the inner lid side;

a lid ring comprising:

(i) a hinge portion pivotably coupled to the base via a base recess such that the rotatable lid assembly is pivotable relative to the jar assembly;

(ii) a protruding portion disposed within the gap; and (iii) one or more biasing elements disposed at a top of the lid ring and configured to apply a force; and a liner disposed on an underside of the inner lid portion and configured to contact the circumferential edge of the jar when the rotatable lid assembly is in a rotatably closed position, wherein the outer lid portion and the inner lid portion are configured to move relative to the lid ring in a first direction toward the hinge portion in response to a force applied by a user, and wherein the outer lid portion and the inner lid portion are configured to move in a second direction away from the hinge portion in response to the force applied by the one or more biasing elements.

13. A rotatable lid assembly for use with ajar and lid assembly, the rotatable lid assembly comprising:

an outer lid portion having an outer lid side extending substantially perpendicular from an outer lid top of the outer lid portion;

an inner lid portion having an inner lid side extending substantially perpendicular from an inner lid top, the inner lid side being spaced from the outer lid side to provide a gap extending between the outer lid side and the inner lid side;

a lid ring comprising:

(i) a hinge portion configured to be pivotably coupled to a jar assembly having a jar and a base portion having a base recess; and (ii) a lid ring protruding portion disposed within the gap; and a liner disposed on an underside of the inner lid portion and configured to contact a circumferential edge of the jar of the jar assembly when the rotatable lid assembly is in a rotatably closed position relative to the jar, wherein the outer lid portion and the inner lid portion are configured to be movable simultaneously relative to lid ring.

14. The rotatable lid assembly according to claim 13, wherein the lid ring has a lid ring side surface extending between the hinge portion and the lid ring protruding portion, the surface facing the outer lid portion, and the outer lid portion and inner lid portion are further configured to be movable along a length of the lid outer side surface.

15. The rotatable lid assembly according to claim 14, wherein the outer lid portion includes a lower protrusion and an upper protrusion spaced from the lower protrusion, and the lower protrusion moves along the length of the lid ring side.

16. The rotatable lid assembly according to claim 13, wherein the inner lid portion further comprises inner lid threads configured to contact jar threads of the jar assembly such that the contact between the inner lid threads and the jar threads provides a resistive force to prevent movement of the outer lid portion and the inner lid portion relative to the lid ring in a direction toward the hinge portion.

17. The rotatable lid assembly according to claim 13, wherein the outer lid portion and the inner lid portion are configured to be moved relative to the lid ring in a direction away from the hinge portion such that the liner is substantially parallel to the circumferential edge of the jar when the rotatable lid assembly is in a pivotably closed position.

18. The rotatable lid assembly according to claim 17, wherein the outer lid portion and the inner lid portion are configured to be moved relative to the lid ring in the direction away from the hinge portion in response to a force applied by a user.

19. The rotatable lid assembly according to claim 17, wherein the lid ring further comprises one or more biasing elements disposed at a top of the lid ring and configured to apply a force, and the outer lid portion and the inner lid portion are configured to be moved relative to the lid ring in the direction away from the hinge portion in response to the force applied by one or more biasing elements.

* * * * *